US006155343A

United States Patent [19]

Nazzal et al.

[11] Patent Number: 6,155,343

[45] Date of Patent: Dec. 5, 2000

[54] SYSTEM FOR CUTTING MATERIALS IN WELLBORES

[75] Inventors: Gregory R. Nazzal, Kingwood; Gerald D. Lynde, Houston, both of Tex.

[73] Assignee: Baker Hughes Incorporated, Houston, Tex.

[21] Appl. No.: 08/848,961

[22] Filed: May 2, 1997

Related U.S. Application Data

[60] Provisional application No. 60/040,883, Oct. 25, 1996.

[51] Int. Cl.[7] ..... E21B 29/00; E21B 29/06

[52] U.S. Cl. ..... 166/55; 166/50; 166/55.1; 166/222

[58] Field of Search ..... 166/298, 55, 50, 166/223, 222, 55.1

[56] References Cited

U.S. PATENT DOCUMENTS

| | | | |
|---|---|---|---|
| 4,978,260 | 12/1990 | Lynde et al. | 166/55.6 |
| 5,381,631 | 1/1995 | Raghavan et al. | 166/298 X |
| 5,445,220 | 8/1995 | Gurevich et al. | 166/55 |
| 5,499,678 | 3/1996 | Surjaatmadja et al. | 166/298 |
| 5,509,480 | 4/1996 | Terrel et al. | 166/297 |
| 5,715,891 | 2/1998 | Graham | 166/313 |
| 5,730,221 | 3/1998 | Longbottom et al. | 166/298 |
| 5,791,417 | 8/1998 | Haugen et al. | 166/298 |
| 5,924,489 | 7/1999 | Hatcher | 166/298 |

*Primary Examiner*—Hoang Dang
*Attorney, Agent, or Firm*—Madan, Mossman & Sriram, P.C.

[57] ABSTRACT

The present invention provides a downhole cutting tool for cutting materials at a worksite in a wellbore. The cutting tool includes a cutting end that is adapted to discharge a high pressure fluid therefrom. A power unit in the tool includes a plurality of serially arranged pressure stages, wherein each such stage increases the fluid pressure above its preceding stage until the desired high pressure has been obtained. The high pressure fluid is discharged through the cutting end to effect cutting of a material. A pulsar in the tool is provided to pulse the fluid before it is discharged through the nozzle, which enables the use of lower pressure compared to the pressure required without pulsation of the fluid. A control unit controls the position and orientation of the cutting end relative to the material and may be programmed to cut the material according a predetermined pattern provided to the control unit. An imaging device may be included in the downhole cutting tool to obtain images of the worksite prior to and after the cutting operations.

28 Claims, 3 Drawing Sheets

SYSTEM FOR CUTTING MATERIALS IN WELLBORES

This application claims priority from Provisional Application Ser. No. 60/040,883 filed with the United States Patent and Trademark Office on Oct. 25, 1996.

BACKGROUND OF THE INVENTION

1. Field of the Invention

This invention relates generally to cutting or milling tools for cutting materials in wellbores and more particularly to cutting tools utilizing a pressurized fluid for cutting materials in wellbores.

2. Background of the Art

To produce hydrocarbons (oil and gas) from the earth's formations, wellbores are formed to desired depths. The first few hundred feet of the wellbore are typically large in diameter, usually between 12 and 18 inches, and are lined with a metal casing, about one half inch thick or more to prevent caving of the wellbore. The wellbore, which is typically between nine to twelve inches in diameter, is then drilled to recover hydrocarbons from the subsurface formations. After the wellbore has been drilled to the desired depth, a metal pipe, generally referred to in the art as the casing or pipe, is set in the wellbore by injecting cement between the casing and the wellbore annulus. Branch or lateral wellbores are frequently drilled from a main wellbore to form deviated or horizontal wellbores for improving production of hydrocarbons from subsurface formations.

There are many operations (work) to be performed in the wellbore. Often it would be advantageous to be able to "see" (image) a particular worksite, determine what specific work needs to be performed based on the imaging information and then perform the work, preferably with tools that have been run downhole at the same time as the imaging equipment.

The current technique is to run imaging equipment downhole, collect the imaging information and then pull the imaging equipment out of the borehole before running the necessary tool(s) downhole to do the work. The work that may be performed may include: testing, inspection, cutting, fishing, repairing, sealing, welding and/or cementing. Some cutting examples are noted below.

In many applications, the branch wellbores are formed after the wellbore has been cased. This requires milling or cutting a section (window) in the casing at a predetermined depth to initiate the drilling of the branch wellbore. It is highly desirable to cut such windows with enough precision to preserve the eventual junction integrity. In older wellbores, the junctions between the main wellbore and the branch wellbore may be eroded and may require the removal of certain materials therefrom to repair such junctions or to perform secondary operations. It is desirable to remove the materials from the junctions with precision in order to properly reconstruct the junctions. Therefore, it is desirable to have a downhole cutting or milling tool that can selectively and relatively accurately cut windows in the casing downhole and also remove a desired amount of materials around the junctions. The present invention provides such a downhole cutting tool.

After the wellbore has been cased, various types of equipment, such as liner hangers, packers, fluid flow control devices, etc., are installed (set) in the wellbore. Some of these devices are permanently set in the wellbore and must be milled to perform secondary operations. Other devices, although designed to be retrieved, cannot be so removed from the wellbore due to malfunctions of such devices or excessive corrosion and, therefore, these devices must be milled.

Additionally, sediments tend to slowly settle along the interior surfaces of production tubing, which reduces the effective annulus of such tubing. From time to time, such sediments must be reamed to maintain the desired fluid flow through the tubing.

Various types of downhole cutting and milling tools have been utilized in the oil and gas industry. Such tools have been used for removing materials from within wellbores including cutting existing casings, for boring through permanently set packers and for removing loose joints of pipes. Milling tools have been used to ream collapsed casings, to remove burrs or other imperfections from windows in the casings, to place whipstocks for drilling directional wellbores and to perform other reaming operations.

Prior art cutting or milling tools typically include a tool body that is adapted to be conveyed into the wellbore. A plurality of cutting blades are placed on the body at spaced intervals extending outwardly therefrom. Each of the blades typically have a base with a leading surface relative to the direction of rotation. A suitable hard cutting material, such as carbide, is secured to the cutting edge. To perform a cutting or milling operation, the tool is placed at a desired location within the wellbore and rotated to cut the intended material. The weight on the tool and the rotational speed determine the cutting speed. The tool blades are designed to cut the material in small segments so that the cuttings may be transported to the surface by circulating a fluid in the wellbore or dropped to the wellbore bottom. A commonly used downhole cutting tool of the type described above is disclosed in U.S. Pat. No. 4,978,260, issued to Gerald Lynde and assigned to the assignee of this application.

The cutting elements of such prior art must remain in hard contact with the material to be cut, which erodes the cutting elements. The operating life of such cutting elements in some applications, therefore, can be relatively short. In such cases, the cutting tool must be retrieved for changing the cutting element. This type of operation can result in lost time for the well and/or rig. This lost time can cost several thousand dollars per day.

The cutting area of prior art cutting tools is relatively large and, thus, such tools do not cut relatively precise sections or windows in the casings. It is also difficult to orient such prior art cutting tools to perform contoured cutting of areas within the wellbores.

The present invention addresses many of the deficiencies of the prior art cutting or milling tools and provides tools wherein the cutting element is relatively small, does not contact the surface to be cut and can cut materials in a wellbore relatively precisely. The small cutting element enables making precise cuts while the non-contacting aspect of the tool increases the life of the cutting element. The cutting element can be continuously positioned and oriented in the wellbore to perform cutting operations along a predetermined profile or trace, which allows performing relatively precise cutting operations.

Additionally, by incorporating the cutting tool with imaging equipment that is run downhole at the same time as the cutting tool, it is possible to image the worksite, determine the type of cut that needs to be made, sending the proper signals to the cutting tool and perform the cutting operation with a single downhole run.

SUMMARY OF THE INVENTION

The present invention provides a downhole cutting tool for cutting materials at a worksite in a wellbore. The cutting tool includes a cutting element that is adapted to discharge a high pressure fluid therefrom. A power unit in the tool includes a plurality of serially arranged pressure stages, wherein each such stage increases the fluid pressure above its preceding stage until the desired high pressure has been obtained. The high pressure fluid is discharged through the cutting element to effect cutting of a material. A pulsar in the tool is provided to pulse the fluid before it is discharged through the cutting element, which enables the use of lower pressure compared to the pressure required without pulsation of the fluid. A control unit controls the position and orientation of the cutting end of the cutting element relative to the material to be cut. The control unit may be programmed to cut the material according a predetermined pattern provided to the control unit. An imaging device may be included in the downhole cutting tool to obtain images of the worksite prior to and after the cutting operations.

The present invention provides a method for cutting a material at a worksite in a wellbore by a cutting tool which has a cutting element that is adapted to discharge a high pressure fluid therefrom. The method of the invention includes the steps of: (a) conveying the cutting tool near the worksite; (b) positioning the cutting element a predetermined distance from the material to be cut; (c) discharging the high pressure fluid from the cutting element at a predetermined pressure that is sufficient to cut the material; and (d) moving the cutting element according to a predetermined pattern to cut a desired amount of material from the worksite.

The present invention also provides methods for deploying a cutting tool under water and cutting structural support members embedded in a seabed to disengage an offshore structure from the seabed or cutting portions of such under water structures. Additionally, the present invention provides a method of cutting sections of nested pipes to facilitate the removal of such pipes from a borehole.

Examples of the more important features of the invention have been summarized rather broadly in order that the detailed description thereof that follows may be better understood, and in order that the contributions to the art may be appreciated. There are additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiments, taken in conjunction with the accompanying drawings, in which like elements have been given like numerals, and wherein.

DETAILED DESCRIPTION OF PREFERRED EMBODIMENTS

Figure 1:
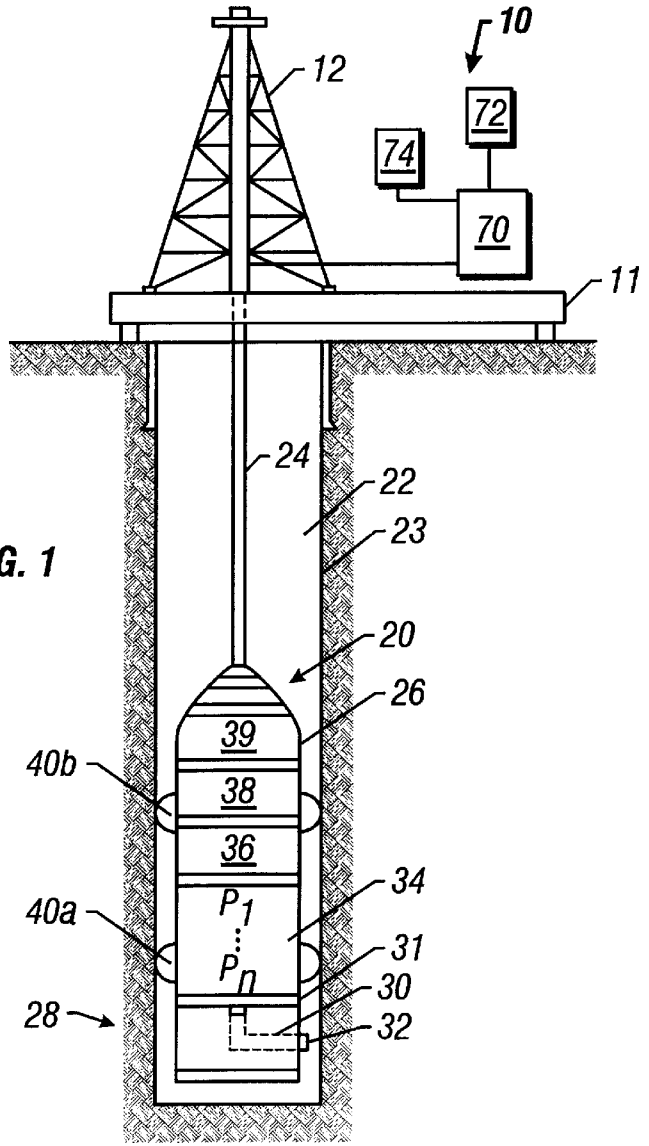
FIG. 1 is a schematic diagram of an embodiment of a cutting system wherein the cutting element of the downhole cutting tool is shown positioned in a wellbore for cutting a section from the wellbore casing.

FIG. 1 is a schematic diagram of a system 10 for cutting or milling materials in a wellbore (borehole) 22. In general, the cutting system 10 incorporates a downhole tool which includes a cutting element positioned in the wellbore a predetermined distance from the material or member to be cut. The cutting element discharges through a cutting element, such as a nozzle, a relatively high pressure fluid that is sufficient to cut the member. The downhole tool contains a power unit for supplying the high pressure fluid to the cutting element. The cutting element may be continuously positioned and oriented at the desired location about the member to be cut by a control circuitry contained in the downhole tool and/or at the surface.

Referring to FIG. 1, the system 10 shown therein includes a downhole cutting tool (herein referred to as the "cutting tool") 20 conveyed from a platform 11 of a derrick 12 into a borehole 22 by a suitable conveying means 24, such as a tubing or a wireline. The cutting tool 20 has a tubular housing 26, which is adapted for connection with the conveying means 24 via a suitable connector 19. The housing 26 contains the various elements of the cutting tool 20, which include a cutting element section 28, a power section 34 for supplying pressurized fluid to the cutting element section 28, a control unit 36 which controls the vertical and radial position of the control element 28 and a downhole electronic section 38 for housing the circuitry and memory associated with the downhole tool 20.

The bottom section 28 of the housing 26 houses a cutting element 30 that terminates in a nozzle or probe 32 suitable for discharging a relatively high pressure fluid therefrom in the form of a jet stream of a relatively small cross sectional area. For the majority of downhole cutting or milling applications, water discharged at a pressure greater than 110,000 psi may be adequate in removing materials from within a wellbore. In cutting pipes, which are more than one-half inch thick, higher pressure may be required. The nozzle 32 may be made strong enough to withstand discharge pressures of greater than 200,000 psi. The section 28 is preferably rotatable about a joint 31 that connects the section 28 with a hydraulic power section, generally denoted herein by numeral 34.

The fluid can be water or wellbore fluid or any other fluid with similar properties. Additionally, abrasive material can be mixed with the fluid to provide additional cutting properties.

The power section 34 preferably includes a plurality of serial sections $P_1$–$P_n$, each of which increases the pressure of a fluid above the pressure of the preceding section by a predetermines amount. The last section $P_n$ discharges the fluid into the cutting element section 28 at the desired pressure. The power section 34 also may contain a device (not shown) for pulsing the fluid supply through one or more of the power sections $P_1$–$P_n$ such that the fluid supplied to the cutting element 30 is pulsed at the predetermined rate.

High pressure pulsed jet stream is generally more effective in cutting materials than non-pulsed jet streams. The cutting element 30 may be a telescopic member that may be moved along the tool longitudinal axis (axially) within the section 28 to allow positioning the nozzle 32 at the desired depth adjacent to the wellbore casing 23. In an alternative embodiment, the section 28 may be fixed while the nozzle 32 may be rotated radially about the tool longitudinal axis. The above described movements of the cutting element 30 provide degrees of freedom along the axial and radial directions within the wellbore 22, thereby allowing accurate positioning of the nozzle at any location within the wellbore 22.

Figure 4:
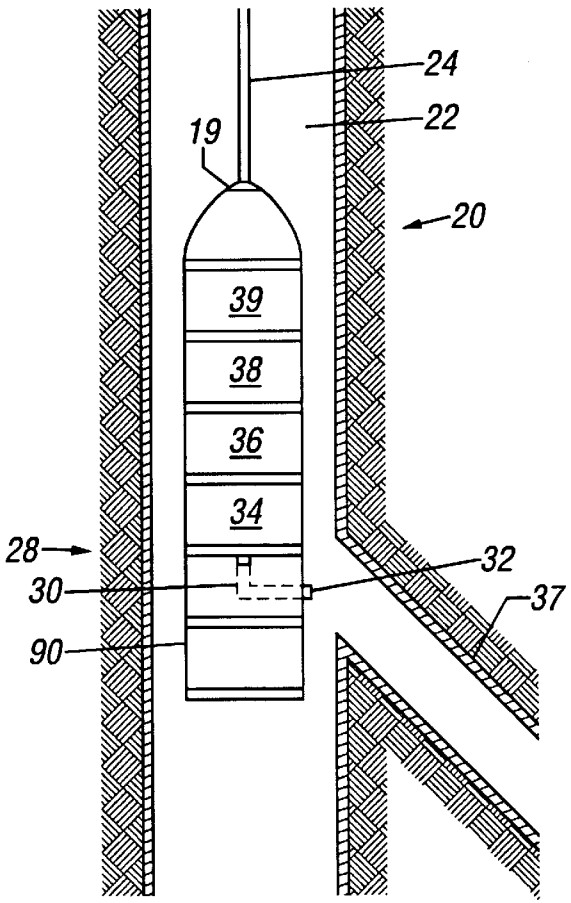
FIG. 4 is a schematic diagram of the downhole area shown in FIGS. 2*a–c* with a downhole imaging tool attached thereto for obtaining the image of the material to be cut before and after the cutting operation.

A section 36 placed above the power section 34 contains devices for orienting the nozzle tip 32 at the desired position. The cutting element section 28 is rotated about the wellbore axis to radially position the nozzle tip 32. The cutting element 30 is moved axially to position the nozzle tip 32 along the wellbore axis. Downhole hydraulically operated devices or electric motors have been utilized for performing such functions. Any such suitable device may be utilized for the purpose of this invention. The section 36 also preferably includes sensors for providing information about the tool inclination, nozzle position relative to the material to be cut and to one or more known reference points in the tool. Such sensors, however, may be placed at any other desired locations in the tool 20. In the configuration shown in FIG. 1, the cutting element 30 can cut materials along the wellbore interior, which may include the casing 23 or an area around a junction between the wellbore 22 and a branch wellbore 37, as shown in FIG. 4.

Figure 2A:
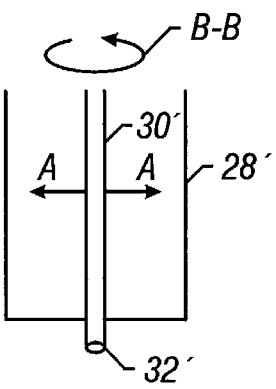
FIG. 2*a* shows a manner of positioning the cutting element in the downhole cutting tool to cut a member beneath the cutting tool.

In applications where the material to be cut is below the cutting tool 20, the cutting element 30 may be designed with a configuration that is suitable for such applications. FIG. 2*a* shows a configuration of a cutting element 30' that may be utilized to cut materials below the cutting tool 20 in the wellbore 22. In this configuration, the nozzle 32' discharges the fluid downhole along the tool axis. The cutting element 30' may be moved at any desired location within the section 28'. Arrows A—A indicate that the cutting element 30' may be moved radially while the circular motion defined by arrows B—B indicates that the cutting element 30' may be moved along a circular path within the section 28'. The cutting element configuration shown in FIG. 2*a* is useful for performing reaming operations in a tubular member, such as a production tubing, which are required when interior of the tubing is lined with sediments.

Figure 2B:
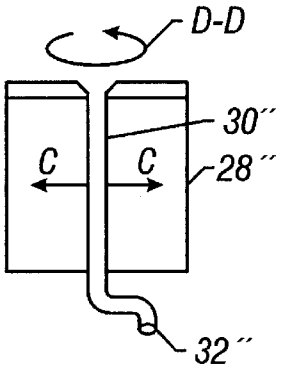
FIGS. 2*b–c* illustrate an alternative manner for positioning the cutting element in the downhole cutting tool to cut materials beneath the cutting tool.
Figure 2C:
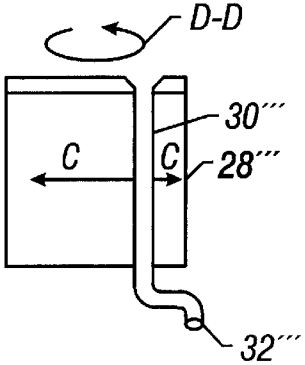

To remove a permanent packer or a packer that cannot otherwise be removed, perhaps due to a malfunction, it is desirable to cut away only the packing elements and the associated anchors, if any, which typically lie between a packer body and the wellbore interior. The packers and anchors typically engage the casing at areas that are far less than the tool body. Prior art tools typically cut through the entire packer, which can take excessive time. The packers can readily be removed only by cutting the packing elements and any associated anchors disposed between the packer and the casing annulus. In such applications, the cutting nozzle needs to be positioned over the packing element alone. FIGS. 2*b–c* show a configuration of the cutting element 30" whose nozzle 32" may be placed at any desired location above a packing element within the wellbore and then rotated to cut through the such element below the nozzle. Arrows C—C indicate that the nozzles 32" may be moved radially within the section 28" while the circular path defined by arrows D—D indicates that the cutting element may be rotated within the wellbore 22. FIG. 2*c* shows the position of the cutting element 30'" after it has been moved radially a predetermined distance. As is seen in FIG. 2*c*, the nozzle tip 32'" extends beyond the section 28'" which will allow the tool 20 to cut a material anywhere below the tool 20.

As shown in FIG. 1, electrical circuits and downhole power supplies for operating and controlling the operation of the cutting element 30, the power unit 34, and the devices and sensors placed in section 34 are preferably placed in a common electrical circuit section 38. Electrical connections between the electrical circuit section 38 and other elements are provided through suitable wires and connectors.

A surface control unit 70 placed at a suitable location on the rig platform 11 preferably controls the operation of the cutting system 10. The control unit 70 includes a suitable computer, associated memory, a recorder for recording data and a display or monitor 72. Suitable alarms 74 are coupled to the surface control unit 70 and are selectively activated by the control unit 70 when certain predetermined operating conditions occur. The operation of control units, such as the control unit 70, is known and is, thus, not described in detail herein.

The operation of the cutting system 10 will now be described with respect to cutting a section or window in a casing while referring to FIGS. 1 and 3. The tool 20 is conveyed downhole and positioned such that the nozzle 32 is adjacent the section to be cut. The stabilizers 40*a*–b are then set to ensure minimal radial movement of the tool 20 in the wellbore 22. A cutting profile 80 (FIG. 3) defining the coordinates for the outline of the section to be cut is stored in a memory associated with the system 10. Such memory may be in the downhole circuit 36 or in the surface control unit 70.

Figure 3:
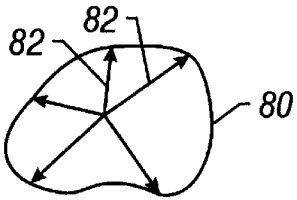
FIG. 3 is a schematic diagram of an example of a predetermined profile of a section of the casing to be cut that may be stored in a memory associated with the cutting system of the present invention for later use.

An example of such a profile 80 is shown in FIG. 3. The arrows 82 define the vectors associated with the profile 80. The profile 80 is preferably displayed on the monitor 72 at the surface. An operator orients the nozzle tip 32 at a location within the section of the casing 23 to be cut. The desired values of the fluid pressure and the pulse rate are input into the surface control unit 70 by a suitable means, such as a keyboard, or are selected from a prerecorded data, preferable in the form of a menu. The tool 20 is then activated to generate the required pressure and the pulse rate, if any. The power section 34 causes the fluid to pulse at a predetermined rate and the fluid pressure to rise to a predetermined value. The fluid to the tool 20 is preferably provided from the surface via the tubing 24. Alternatively, the wellbore fluid may be used.

If the section to be cut is such that it will remain in position after it has been cut, perhaps due to the presence of a cement bond, or if the cut section can be dropped to the wellbore bottom as debris, then the system 10 may be set so that the nozzle tip 32 will follow the profile 80, either by manual control by the operator or due to the use of a computer model or program in the system. If the section must be cut into small pieces or cutting so that they may be transported to the surface, the cutting element is moved within the profile at a predetermined speed along a predetermined pattern, such as a matrix. This method ensures that the casing section will be cut into pieces that are small enough to be transported to the surface by circulating a fluid through the wellbore, as is commonly done for such purpose. During operations, the downhole circuits contained in the section 38 communicate with the surface control unit 70 via a two-way telemetry. The downhole telemetry is preferably contained in a section 39.

FIG. 4 shows the downhole tool of FIG. 1 with an imaging device 90 attached below the cutting section 28. Imaging tools to image a borehole interior have been provided in the art and, therefore, are not described in detail herein. The imaging device 90 is utilized to confirm the shape of the section of the casing or the junction after the cutting operation has been performed. The imaging device 90 may also be utilized to image the area to be cut to generate the desired cutting profile and then to confirm the cut profile after the cutting operation.

Figure 5:
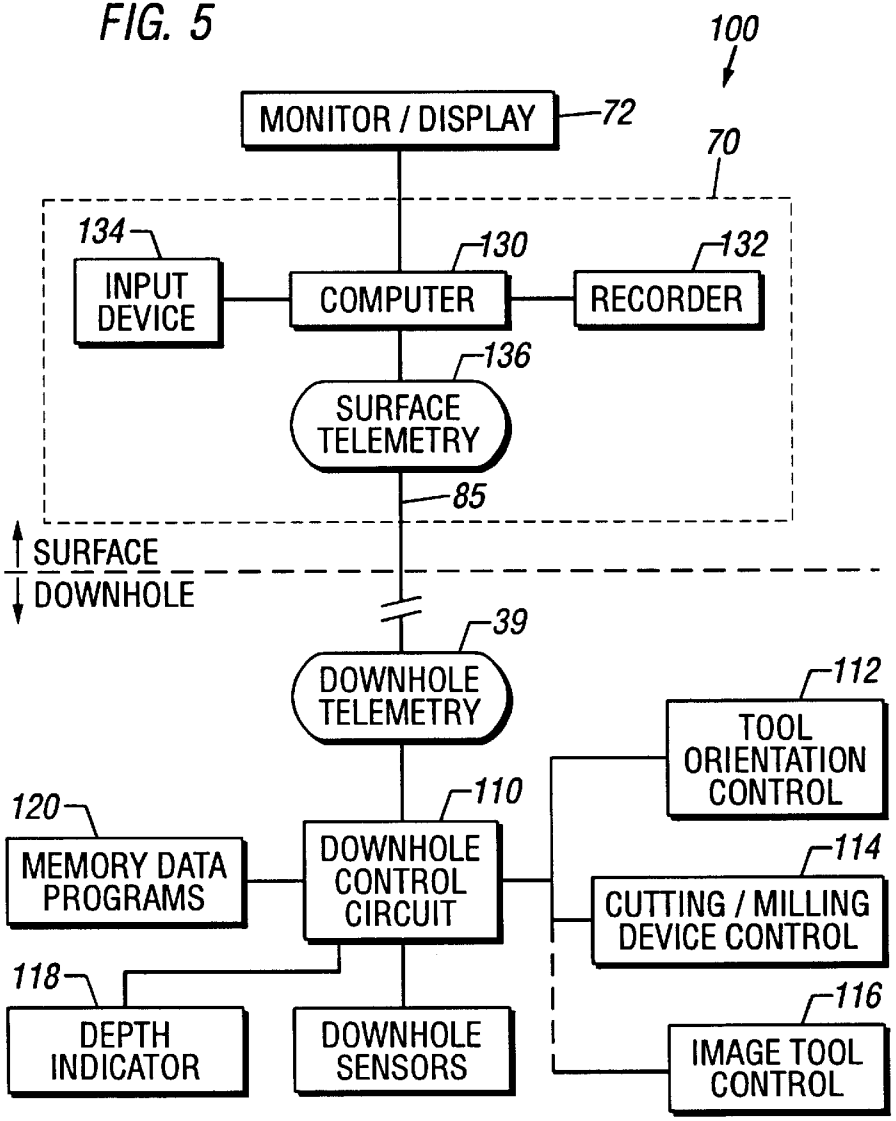
FIG. 5 is a schematic functional block diagram relating to the operation of the cutting system shown in FIGS. 2*a–c*.

FIG. 5 is a functional block diagram of the control circuit 100 for the cutting system 10 (see FIG. 1). The downhole section of the control circuit 100 preferably includes a microprocessor-based downhole control circuit 110. The downhole control circuit 110 determines the position and orientation of the tool as shown in box 112. The downhole control circuit 110 controls the position and orientation of the cutting element 30 (FIG. 1) as shown in box 114. During operations, the downhole control circuit 110 receives information from other downhole devices and sensors, such as a depth indicator 118 and orientation devices, such as accelerometers and gyroscopes.

The downhole control circuit 110 communicates with the surface control unit 70 via the downhole telemetry 39 and via a data or communication link 85. The downhole control circuit 110 preferably controls the operation of the downhole devices, such as the power unit 34, stabilizers 40*a–b* and other desired downhole devices. The downhole control circuit 110 includes memory 120 for storing therein data and programmed instructions. The surface control unit 70 preferably includes a computer 130, which manipulates data, a recorder 132 for recording images and other data and an input device 134, such as a keyboard or a touch screen for inputting instructions and for displaying information on the monitor 72. The surface control unit 70 communicates with the downhole tool via a surface telemetry 136.

Figure 6B:
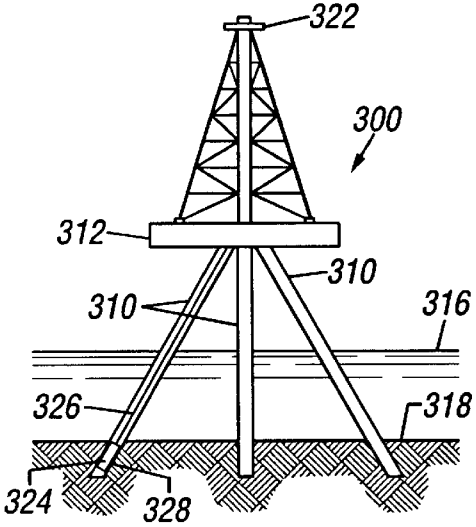
FIGS. 6*a–b* show two different methods of disengaging an offshore structure that is supported on tubular members embedded in the seabed.
Figure 6A:
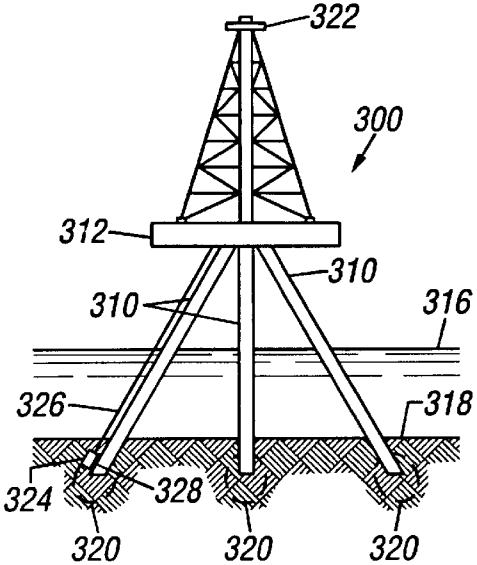

FIGS. 6*a–*6*b* illustrate two methods of disengaging an offshore platform structure 300 from a seabed 318 utilizing a cutting tool such as described above. As shown in FIG. 6*a*, the offshore platform structure 300 is supported on a plurality of structural members 310 that are connected to a base 312 and then extend downward through the water 316 until they are embedded in the seabed 318 at a predetermined depth.

To disengage the platform 300, a cutting tool 324 is conveyed from the platform base 312, via a device such as coiled tubing 326 with a tracking device 323 which is controlled by the surface control unit 70 (shown in FIG. 1) or by an underwater controller 325, along the outside periphery of the structural member 310 until it reaches a desired cutting point 328 on the structural member 310. The tracking device 323 can be tracking members (not shown) on the cutting tool 324 that enable the cutting tool 324 to remain latched onto the structural member 310 or a robotic device that guides the cutting tool 324 along the periphery of the structural member 310. The structural member 310 can be of any shape used in the industry. Some examples include a tubular member and an I-beam type member.

The cutting tool 324 also is adapted to travel axially and radially along the structural member 310, controlled by the surface control unit 70 (shown in FIG. 1).

Earthen material 320 surrounding the cutting point 328 is displaced such that the cutting tool 324 can be positioned in its cutting position adjacent the structural member 310. Prior art methods typically use an underwater excavation tool (not shown) to clear an area, approximately forty feet in diameter and twenty feet in depth, around the area to be cut.

With the present invention, however, this expensive and time-consuming method can be eliminated by using the cutting tool 324 itself to clear a pathway. To displace the earthen material 320, the cutting tool nozzle(s) 32 can be oriented downward, and a regulated amount of pressurized fluid released to move the earthen material 320 out of the way of the cutting tool 324 as it progresses towards the cutting point 328. Another method of positioning the cutting tool 324 is to utilize a vibratory source that can be included in the underwater controller 325. The vibrations allow the cutting tool 324 to easily move through the earthen material 320 to the desired cutting point 328.

Once the earthen material 320 has been displaced, the cutting tool 324 continues downward along the outside surface of the structural member 310 until it reaches the predetermined cutting point. Recent changes in the environmental laws permit the cutting point to be above the seabed or below.

The cutting tool 324 then performs the required cut, such as a circumferential cut, around the outside of the structural member 310. To accomplish this cut, the cutting tool 324 is moved around the periphery of the structural member 310 while a jet of high pressure fluid is directed from the cutting tool nozzle 32 at the predetermined cutting line under control of the surface control unit 70 or the underwater controller 325. The cutting tool 324 then is retrieved via the coiled tubing 326 so that the cutting tool 324 can be repositioned along the next structural member 310. This process is continued until all structural members 310 have been cut.

Another preferred method of disengaging an offshore platform 300 is illustrated in FIG. 6*b*. In this example, the structural members 310 are hollow and have such dimensions that the cutting tool 324 can be conveyed to the desired cutting position 328 through the inside of the structural member 310. The cutting tool 324 is lowered from the base 312 of the platform 300 through the hollow structural member 310, via a device such as coiled tubing 326, until the cutting tool 324 is at the desired cutting position 328. Some kind of anchoring device (not shown) is then engaged such that the cutting tool 324 is held at the proper level within the structural member 310 while the cutting tool nozzle 32 rotates axially around the inside diameter of the structural member 310 while performing the cut.

The cutting tool 324 then performs the desired cut (such as described above) along the inside diameter of the structural member 310 and is retrieved via the coiled tubing 326 for repositioning inside the next structural member 310. This process is repeated until all structural members 310 have been cut allowing the platform to be removed from its location on the seabed 318.

The cutting tool 324 described in FIGS. 6*a–*6*c* also can be used under water to cut a portion of the structural member 310 such as a window.

Figure 7:
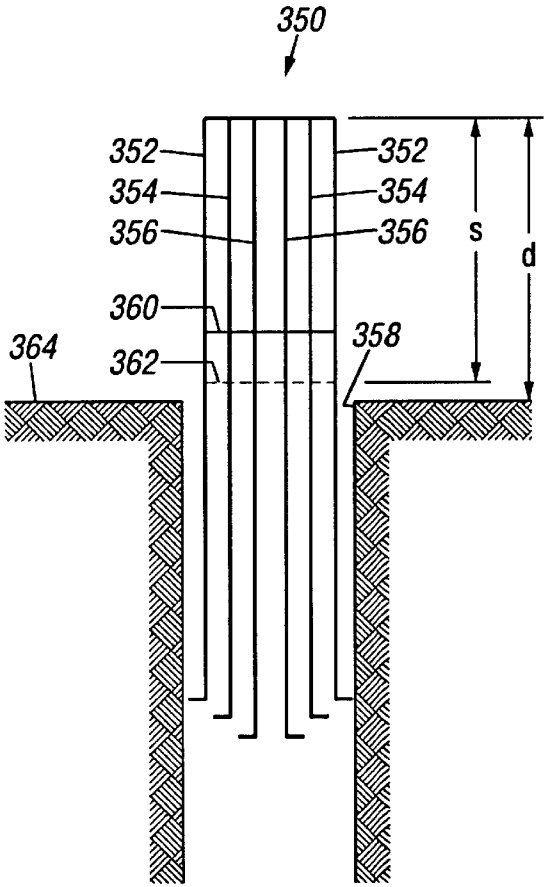
FIG. 7 illustrates a method of the preferred embodiment for the removal of nested pipes from a wellbore.

Another preferred method relating to cutting processes at a borehole 358 and utilizing a cutting tool such as the one of the present invention is illustrated in FIG. 7. A typical borehole 358 contains nested pipes 350 which may have varying lengths. In this example, the nested pipes 350 contain three pipes 352, 354 and 356 and may have cement between the pipes. To remove the nested pipes 350 from the borehole 358, the nested pipes 350 are first pulled a distance d from the borehole 358 such that the bottom of a first section s of the nested pipes 350 is above the surface 364. This section s of the nested pipes 350 is then connected together at a location 360 above the bottom of the section s.

The connection can be made by many methods known in the art such as by drilling through the nested pipes 350 and inserting a connecting rod 361. A cutting tool (not shown) is then used to cut through the nested pipes 350 at a point below the connecting rod 361 near the bottom of the section s of the nested pipes 350. This section s then is removed and conveyed to another location. The process is repeated for additional sections s of the nested pipes 350 until the desired amount of nested pipes 350 have been removed from the borehole 358.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. A cutting tool adapted to be positioned in a wellbore for cutting a material in the wellbore, comprising:

(a) a cutting unit having:

(i) a nozzle for discharging a high pressure fluid therefrom; and (ii) a power unit in the tool for supplying the fluid to the nozzle at pressure that is sufficient to cut the material; and (b) a device within the cutting tool for orienting the nozzle at a predetermined position in the wellbore for effecting the cutting of the material.

2. The cutting tool of claim 1, further having a device for causing the nozzle to move radially within the wellbore.

3. The cutting tool of claim 2, further having a device for moving the nozzle in an axial direction with respect to the wellbore axis.

4. The cutting tool of claim 3, wherein the device for moving the nozzle in the axial direction includes a telescopic device.

5. The cutting tool of claim 1, further having an electrical control circuit associated therewith for controlling the operation of the cutting unit.

6. The cutting tool of claim 5, wherein at least a portion of the electrical control circuit is contained in the cutting tool.

7. The cutting tool of claim 5, wherein the electrical control circuit further comprises a surface control circuit that is in data communication with the electrical control circuit in the cutting tool for controlling the operation of the cutting tool.

8. The cutting tool of claim 1, wherein the power unit further comprises a plurality of successive stages, wherein each successive stage increases the pressure of the fluid by a predetermined amount above the preceding stage.

9. The cutting tool of claim 8, further comprising a device for pulsing the fluid discharged from the nozzle.

10. The cutting tool of claim 9, wherein the pulse rate and the fluid pressure define the cutting rate of the material.

11. The cutting tool of claim 1, further having a surface control unit for controlling the operation of the cutting tool, said surface control unit having stored therein a cutting profile defining a section of the material to be cut by the cutting tool.

12. The cutting tool of claim 11, wherein the surface control unit causes the cutting tool to cut a section of the material according to the cutting profile.

13. The cutting tool of claim 12, wherein the surface control unit causes the cutting tool to cut the section of the working area according to a predetermined pattern within the boundaries of the cutting profile in a manner that will produce cuttings of the material being cut of a size that is conducive to be transported to the surface by circulating a fluid through the wellbore.

14. The cutting tool of claim 1, further having stored within the cutting tool a cutting profile defining a section of the working area to be cut by the cutting tool.

15. The cutting tool of claim 14, wherein the cutting tool cuts a section of the material according to the cutting profile.

16. The cutting tool of claim 1, further comprising an imaging device which is adapted to obtain an image of a working area containing the material.

17. The cutting tool of claim 16, wherein the imaging device is placed above the power unit.

18. The cutting tool of claim 1, wherein the fluid is supplied from the surface.

19. The cutting tool of claim 1, wherein the fluid is wellbore fluid supplied from the wellbore.

20. The cutting tool of claim 1, wherein the fluid further comprises an abrasive material.

21. The cutting tool of claim 1, wherein the nozzle is further used to discharge the high pressure fluid to displace earthen material surrounding the material to be cut such that the cutting tool can be positioned at the desired cutting location.

22. The cutting tool of claim 6, wherein said electrical control circuit having stored therein a cutting profile defining a section of the material to be cut by the cutting tool.

23. The cutting tool of claim 22, wherein said electrical control circuit causes the cutting tool to cut a section of the material according to said cutting profile.

24. The cutting tool of claim 7, further comprising a two-way telemetry system which allows for communication between said electrical control circuit and said surface control circuit.

25. The cutting tool of claim 24, wherein said two-way telemetry system is located downhole.

26. The cutting tool of claim 24, wherein said two-way telemetry system is located at the surface.

27. A system for cutting a material in a wellbore, comprising:

(a) a downhole tool having (i) a cutting unit having a nozzle for discharging a high pressure fluid therefrom, and (ii) a power unit for supplying the high pressure fluid to the nozzle that is sufficient to cut the material;

(b) a downhole control unit, said downhole control unit causing the nozzle to orient in a predetermined position in the wellbore for effecting the cutting of the material; and (c) a surface control unit adapted to communicate with the downhole control unit, said surface control unit cooperating with the downhole control unit to cause the nozzle to orient along a predetermined direction and cause the power unit to supply the fluid to the nozzle at a predetermined pressure.

28. The system of claim 27, wherein the fluid further comprises an abrasive material.

* * * * *